US006280181B1

(12) United States Patent
Schmidt et al.

(10) Patent No.: US 6,280,181 B1
(45) Date of Patent: Aug. 28, 2001

(54) WITHDRAWAL DEVICE FOR A SHAFT FURNACE

(75) Inventors: Martin Schmidt, Gmunden; Herbert Lassnig, Asten; Johann Wurm, Bad Zell; Kurt Wieder, Schwertberg; Georg Aichinger, Asten; Josef Ziegler, Windischgarsten, all of (AT)

(73) Assignee: Deutsche Voest-Alpine Industrieanlagenbau GmbH (DE)

( * ) Notice: Subject to any disclaimer, the term of this patent is extended or adjusted under 35 U.S.C. 154(b) by 0 days.

(21) Appl. No.: 09/530,985

(22) PCT Filed: Oct. 26, 1998

(86) PCT No.: PCT/EP98/06794

§ 371 Date: Aug. 16, 2000

§ 102(e) Date: Aug. 16, 2000

(87) PCT Pub. No.: WO99/24626

PCT Pub. Date: May 20, 1999

(30) Foreign Application Priority Data

Nov. 7, 1997 (AT) ..... 1892/97

(51) Int. Cl.[7] ..... F27D 3/08

(52) U.S. Cl. ..... 432/95; 432/98; 266/197

(58) Field of Search ..... 432/95, 96, 97, 432/98; 266/197, 195

(56) References Cited

U.S. PATENT DOCUMENTS

| | | | | |
|---|---|---|---|---|
| 1,557,773 | | 10/1925 | Pilcher et al. . | |
| 3,704,011 | * | 11/1972 | Hand et al. | 266/197 |
| 4,413,812 | * | 11/1983 | Pirklbauer et al. | 432/98 |

FOREIGN PATENT DOCUMENTS

| | | |
|---|---|---|
| 0085290 | 8/1983 | (EP) . |
| 0514325 | 11/1992 | (EP) . |
| 0578628 | 1/1994 | (EP) . |

* cited by examiner

*Primary Examiner*—Gregory Wilson
(74) *Attorney, Agent, or Firm*—Ostrolenk, Faber, Gerb & Soffen, LLP

(57) ABSTRACT

The invention relates to a shaft furnace (1), in particular a direct-reduction shaft furnace, having a bed (2) of lumpy material, in particular lumpy material containing iron oxide and/or iron sponge, having worm conveyors (3) which penetrate through the shell of the shaft furnace for discharging the lumpy material from the shaft furnace (1), which conveyors are arranged above the base area of the shaft furnace (1) and are mounted in the shell of the shaft furnace.

10 Claims, 3 Drawing Sheets

1st CHAMBER
2nd CHAMBER
3rd CHAMBER
4th CHAMBER
5th CHAMBER
60
50
40
30
20
10
0
TAKE-OFF VOLUME

1st CHAMBER
2nd CHAMBER
3rd CHAMBER
4th CHAMBER
5th CHAMBER
60
50
40
30
20
10
0
TAKE-OFF VOLUME

1st CHAMBER
2nd CHAMBER
3rd CHAMBER
4th CHAMBER
5th CHAMBER
60
50
40
30
20
10
0
TAKE-OFF VOLUME

WITHDRAWAL DEVICE FOR A SHAFT FURNACE

The invention relates to a shaft furnace, in particular a direct-reduction shaft furnace, having a bed of lumpy material, in particular lumpy material containing iron oxide and/or iron sponge, having worm conveyors which penetrate through the shell of the shaft furnace for discharging the lumpy material from the shaft furnace, which conveyors are arranged above the base area of the shaft furnace and are mounted in the shell of the shaft furnace.

Numerous shaft furnaces, in particular reduction shaft furnaces, of the type described above are known from the prior art. Such a shaft furnace, which is substantially designed as a cylindrical hollow body, generally contains a bed of lumpy material containing iron oxide and/or iron sponge, the material containing iron oxide being introduced into the top part of the shaft furnace. A reduction gas which is derived, for example, from a melter gasifier is blown into the shaft furnace and thus into the solids bed through a plurality of inlet openings which are arranged over the circumference of the shaft furnace in the region of the bottom third of the shaft furnace. The hot dust-laden reduction gas flows up through the solids bed and, in the process, reduces some or all of the iron oxide in the bed to iron sponge.

The fully or partially reduced iron oxide is conveyed out of the shaft furnace by discharge devices which are arranged between the base region of the shaft furnace and the region of the gas inlet openings. These discharge devices are generally designed as worm conveyors which are arranged in the form of a star and convey in the radial direction (with respect to the shaft furnace).

The zone which lies in the region of the shaft base and in which the discharge devices are located is to have a maximum active discharge surface area, in order, on the one hand, to lower the level of the bed material as evenly as possible and, furthermore, to ensure continuous movement of the material in the reaction zone.

With a star-shaped arrangement of worm conveyors, the requirement for a maximum active discharge surface area is only satisfied if each of the worm conveyors takes material out of the bed and conveys it away uniformly over its entire length projecting into the shaft.

To achieve this, the conveying cross section of existing worm conveyors is designed in such a way that, in each section of a worm conveyor, both the removal of material from sections which are arranged at the front, as seen in the direction of conveying, and the removal of bed material from the region surrounding this section, would have to be ensured. This is generally achieved by means of a radius of the paddle or spiral envelope which increases continuously in the direction of conveying. In addition, the conveying volume of each worm section is continuously increased by means of an increasing pitch of the worm spiral in the direction of conveying.

Despite these measures, it has been established that the material at the end of the worm and at the wall of the shaft furnace is taken off at two to three times the rate as that in the central regions of the worm conveyor.

Consequently, the material which is located above the central regions of a worm conveyor has a longer residence time in the shaft furnace than the material above regions which have a high conveying capacity. This increases caking and bridging within the lumpy material above the central areas, while the formation of tunnels within the bed occurs particularly frequently above the regions with a high conveying capacity.

Shaft furnaces which are known from the prior art therefore have the drawback that, when conventional worm conveyors are used, it is impossible to ensure uniform discharge of the bed material situated in the shaft furnace by means of the worm conveyors alone. In conjunction with the regions which can in any case not be touched using worm conveyors arranged in a star shape, i.e. the wedge-shaped regions between two adjacent worm conveyors, and the space which is cleared by the worm conveyor ends in the centre of the shaft furnace, varying residence times of the bed material in the shaft furnace result, leading in turn to a non-uniform reduction process and fluctuating product qualities.

The object of the present invention is therefore to provide a shaft furnace, in particular a direct-reduction shaft furnace, which, by dint of the worm conveyors used therein, provides improved, more uniform discharge of the bed material than shaft furnaces which are known from the prior art and use conventional worm conveyors.

According to the invention, this object is achieved by the fact that the take-off region of each worm conveyor, which projects into the shaft, in the longitudinal direction is divided into at least two adjacent sections, the conveying cross sections of adjacent ends of these sections increasing suddenly in the direction of conveying.

In contrast to all the other regions, the region forming the end of the worm does not have to convey any material out of sections which precede it. Consequently, its entire capacity is free to take material out of the bed. In order to provide regions with such a high conveying capacity in the middle part of the take-off region of the worm conveyor, which projects into the shaft, as well, the take-off region is divided into sections, the conveying cross section being designed in such a way that it increases suddenly at the transition from one section to the next section, as seen in the direction of conveying. In this region having an increased capacity compared to that of the preceding section, it is again possible to remove more material from the bed.

Consequently, in total, a conveying capacity which is more even over the entire length of the worm is achieved, and dividing the take-off region of the worm conveyor, which projects into the shaft, into two such sections alone, if the take-off regions are not excessively long, is sufficient to achieve a significant improvement in the conveying performance compared to a worm conveyor with a conveying cross section which increases continuously in the direction of conveying.

Depending on the length and number of screw turns, the take-off region which projects into the shaft is divided into two or more such sections. An essential criterion when selecting the number of sections is the particular increase in the conveying cross section. With an increasing number of sections or a reduced increase in the conveying cross sections, the shape of the screw and therefore the conveying characteristic more closely approximates that of screws with a continuously increasing conveying cross section.

The sudden increase in the conveying cross section in the region of associated section ends is to have—with respect to the longitudinal axis of the worm conveyor—a mean increase of at least 45°, preferably of at least 60°, particularly preferably of substantially 90°. To keep the frictional forces between the bed material and the end face of the worm spiral in this region and therefore the wear and the drive capacity required as low as possible, it is furthermore advantageous to make this transition at least partially a running transition.

To keep the drive capacity required at a low level, it is furthermore advantageous if the sudden increases in the conveying cross sections are offset with respect to one another, preferably with an even distribution, in the circumferential direction of the conveying cross sections, the take-off region being divided into at least three sections.

According to a preferred embodiment, the conveying cross sections are kept constant within individual sections of a worm conveyor. This embodiment is particularly simple to achieve in terms of manufacturing technology.

According to an embodiment which constitutes an alternative to that described above, the conveying cross sections are designed to increase continuously within individual sections of a worm conveyor. This variant combines the advantages of conventional worm conveyors with those of the worm conveyors according to the invention, i.e. continuously increasing conveying cross sections are combined with regions of increased conveying capacity.

Preferably, the screw surfaces of the worm conveyors are formed by paddles which are mounted on the shafts of the worm conveyors. Although the screw surfaces may also be designed to continue over the entire length of the worm, screw surfaces formed by paddles are easier to produce. In the event of repair being necessary, it is also significantly easier to exchange paddles.

The extent to which the size of the conveying cross section of two adjacent section ends changes, given as the change in its radius, is of the order of magnitude of from two to eight times, preferably two to six times, the mean grain size of the lumpy material to be conveyed, tests having shown that if the take-off region of a worm conveyor is divided into three sections, an increase in the radius of the conveying cross section of approximately three to four times the mean grain size is particularly preferred.

In design terms, this preferred embodiment is brought about by the fact that, for example if paddles are used, the second of two adjacent paddles belonging to different sections is higher than the first paddle by, for example, three times the mean grain size. For example, given a mean grain size of 20 mm, the height of these two paddles therefore differs by 60 mm.

In tests, three times the mean grain size as a measure for the increase in the paddle height was found to be particularly advantageous in obtaining regions with a high conveying capacity.

According to a further feature of the shaft furnace according to the invention, the pitch of the spiral of in each case one worm conveyor is designed to increase in the conveying direction, in a manner known per se, or is initially kept constant in the direction of conveying and then increases further on. In this way, the volume which can be conveyed by the worm conveyor in the direction of conveying is increased, so that the material which is taken out of the bed to an increased extent according to the invention is also actually conveyed out of the shaft furnace.

The shaft furnace according to the invention is explained in more detail below with reference to the drawings, FIG. 1 to FIG. 4, in which.

Figure 1:
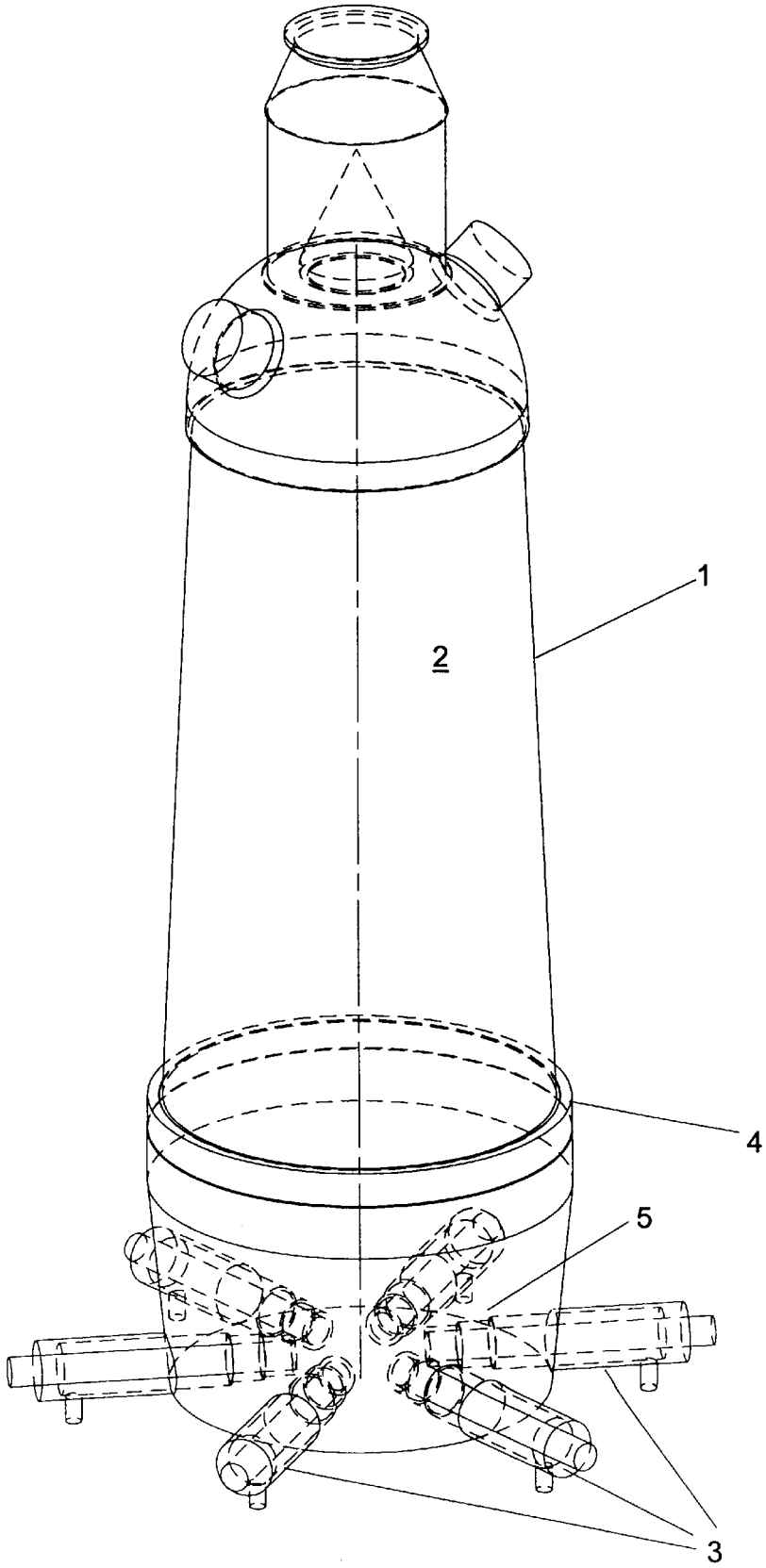
FIG. 1 shows a shaft furnace with worm conveyors

FIG. 1 shows a shaft furnace 1 according to the invention, with the bed 2 of lumpy material and the worm conveyors 3 for discharging the lumpy material from the shaft furnace 1. In the so-called bustle zone 4 along the shell of the shaft furnace, there are a number of gas inlet openings, through which a reduction gas is blown into the bed 2. A number of (in this case six) worm conveyors 3 arranged in the shape of a star above the base of the shaft furnace 1 discharge the lumpy material. The take-off region 5 of each worm conveyor 3, which projects into the shaft, is divided into three sections, the conveying cross sections of the individual sections increasing suddenly in the direction of conveying, i.e. in the direction towards the wall of the shaft furnace 1.

Figure 2:
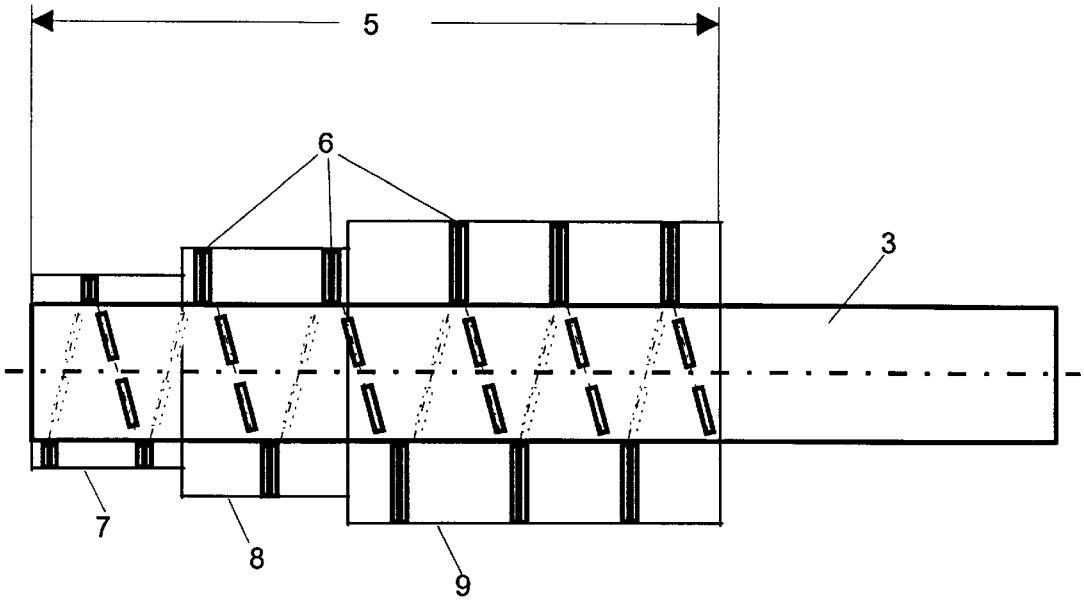
FIG. 2 shows a diagrammatic worm conveyor with a constant conveying cross section of the individual sections
Figure 3:
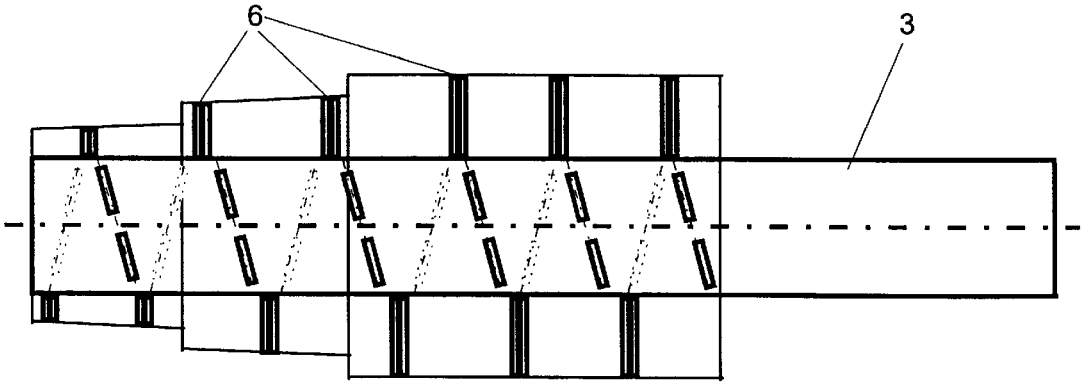
FIG. 3 shows a diagrammatic worm conveyor with an increasing conveying cross section of individual sections FIG. 4 compares the section-related conveying capacities of conventional worm conveyors and worm conveyors according to the invention.

The drawings FIG. 2 and FIG. 3 show two different embodiments of the worm conveyors 3. FIG. 2 shows a cross section through a worm conveyor 3, the conveying part of which, i.e. the take-off region 5 which projects into the shaft, is designed in the form of an interrupted spiral formed by paddles 6. The take-off region 5 is divided into three sections 7, 8, 9, the paddle height at adjacent section ends increasing by three times the mean grain size of the lumpy material which is to be conveyed. Within the individual sections 7, 8, 9, the paddle height and therefore the conveying cross section are kept constant.

The worm conveyor 3 illustrated in FIG. 3 differs from that shown in FIG. 2 in that the height of the paddle 6 is designed to increase continuously in the direction of conveying within individual sections. The paddle height only undergoes a sudden change, to the extent of three times the mean grain size of the lumpy material, at the transition from one section to the next.

Figures 4A, 4B, 4C:
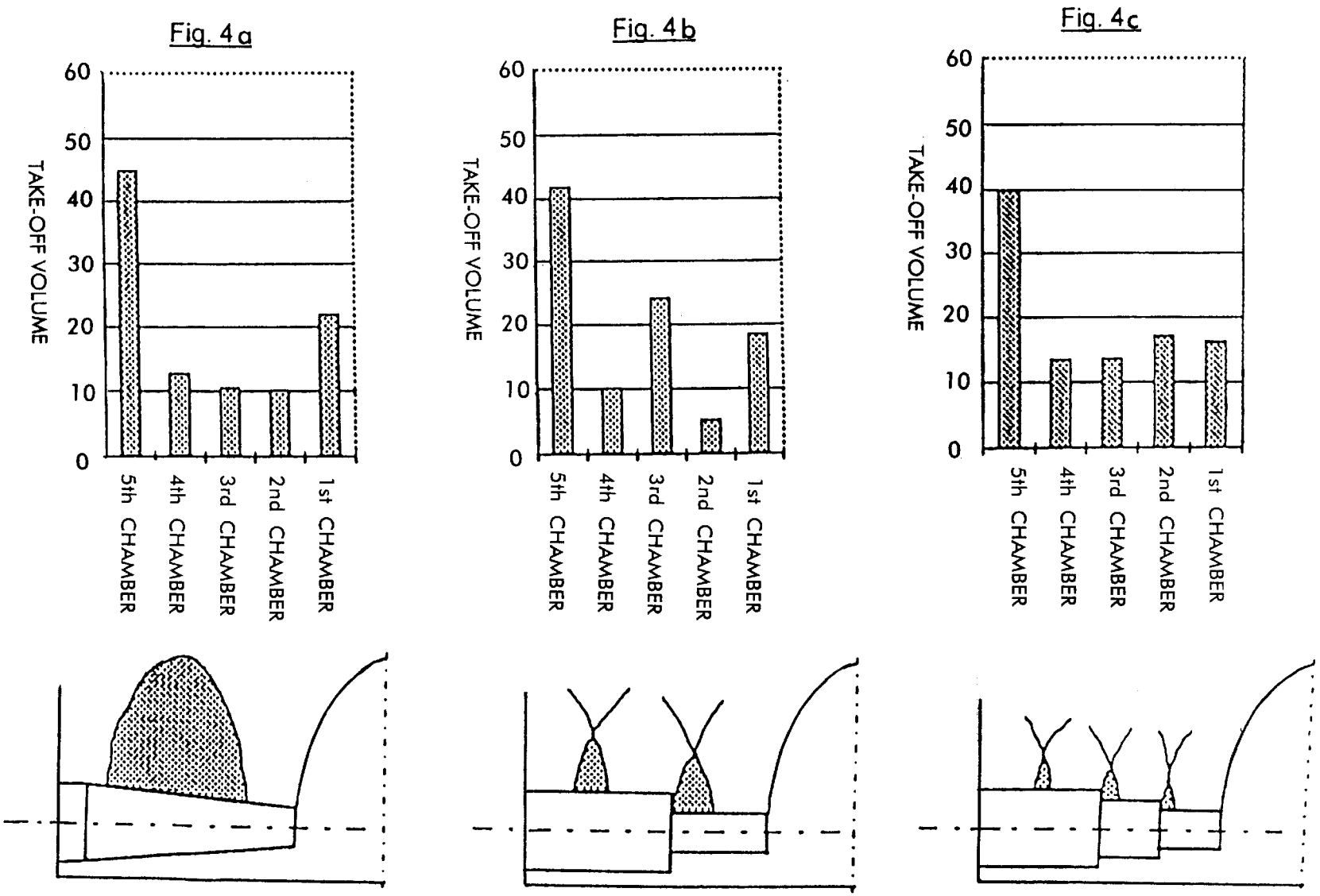

FIGS. 4*a* to 4*c* compare the section-related conveying characteristic of conventional worm conveyors and of worm conveyors having a conveying cross section which increases suddenly. The conveying capacity of a conventional worm conveyor (FIG. 4*a*) is significantly higher at the end of the worm (first chamber) and close to the wall of the shaft furnace ($5^{th}$ chamber) than in the middle regions ($2^{nd}$ to $4^{th}$ chambers) of the worm conveyor. Dividing the worm conveyor into two sections of different conveying cross sections (FIG. 4*b*) results in an increase in the conveying capacity in the region where the conveying cross section increases ($3^{rd}$ chamber). Only division into three sections brings about a conveying capacity which is constant over most of the take-off region.

What is claimed is:

1. Shaft furnace (1), in particular direct-reduction shaft furnace, having a bed (2) of lumpy material, in particular lumpy material containing iron oxide and/or iron sponge, having worm conveyors (3) which penetrate through the shell of the shaft furnace for discharging the lumpy material from the shaft furnace, which conveyors are arranged above the base area of the shaft furnace (1) and are mounted in the shell of the shaft furnace (1), characterized in that the take-off region (5) of each worm conveyor (3), which projects into the shaft, in the longitudinal direction has at least two adjacent sections, the conveying cross sections of adjacent ends of these sections increasing suddenly in the direction of conveying.

2. Shaft furnace (1) according to claim 1, characterized in that the sudden increase in the conveying cross section in the area of associated section ends has—with respect to the longitudinal axis of the worm conveyor (3)—a mean rise of at least 45°, preferably of at least 60°.

3. Shaft furnace (1) according to claim 2, characterized in that the sudden increase in the conveying cross section in the direction of conveying has a rise of substantially 90°.

4. Shaft furnace (1) according to claim 1, characterized in that the take-off region (5) of each worm conveyor (3), which projects into the shaft, in the longitudinal direction has at least three adjacent sections, the sudden increases in the conveying cross sections being offset with respect to one another, preferably with an even distribution, in the circumferential direction of the conveying cross sections.

5. Shaft furnace (1) according to claim 1, characterized in that the conveying cross sections are kept constant within individual sections of in each case one worm conveyor (3).

6. Shaft furnace (1) according to claim 1, characterized in that the conveying cross sections are designed to increase continuously in the direction of conveying within individual sections of in each case one worm conveyor (3).

7. Shaft furnace (1) according to claim 1, characterized in that the screw surfaces of the worm conveyors (3) are formed by paddles (6) mounted on the shafts of the worm conveyors.

8. Shaft furnace (1) according to one of claim 1, characterized in that the increase in the conveying cross section of adjacent section ends of a worm conveyor (3) is formed by an increase in the radius of the conveying cross section by from two to eight times, preferably two to six times, the mean grain size of the lumpy material.

9. Shaft furnace (1) according to claim 8, characterized in that the take-off region of each worm conveyor (3), which projects into the shaft, is divided into three adjacent sections, the increase in the radius of the conveying cross section of adjacent section ends amounting to from three to four times the mean grain size of the lumpy material.

10. Shaft furnace (1) according to one of claim 1, characterized in that the pitch of the spiral of in each case one worm conveyor (3) is kept constant and/or is designed to increase in the direction of conveying.

* * * * *